United States Patent [19]

Foster

[11] Patent Number: 4,471,881

[45] Date of Patent: Sep. 18, 1984

[54] CONTAINER WITH METAL BODY AND PLASTIC HINGE

[75] Inventor: John A. Foster, Rockford, Ill.

[73] Assignee: J. L. Clark Manufacturing Co., Rockford, Ill.

[21] Appl. No.: 508,721

[22] Filed: Jun. 28, 1983

[51] Int. Cl.[3] ..... B65D 43/16

[52] U.S. Cl. ..... 220/339; 220/334

[58] Field of Search ..... 220/339, 338, 334, 342, 220/343

[56] References Cited

U.S. PATENT DOCUMENTS

| | | | |
|---|---|---|---|
| 2,509,462 | 5/1950 | Vogel | 220/334 |
| 2,746,081 | 5/1956 | Gershen | 220/339 |
| 2,939,169 | 6/1960 | Anderson | 220/334 X |
| 3,095,995 | 7/1963 | Foster | 220/60 |
| 3,155,269 | 11/1964 | Schurman et al. | 220/334 |
| 3,187,964 | 6/1965 | Foster | 222/480 |
| 3,251,509 | 5/1966 | Foster | 222/153 |
| 3,695,481 | 10/1972 | Foster et al. | 220/334 X |
| 3,749,230 | 7/1973 | Foster | 206/1.5 |

*Primary Examiner*—Steven M. Pollard

*Attorney, Agent, or Firm*—Leydig, Voit, Osann, Mayer & Holt, Ltd.

[57] ABSTRACT

Lugs secure the mounting leaf of a plastic hinge within an inwardly offset recess formed in the upper lip portion of a metal container body. Flexible hinge straps are molded integrally with the mounting leaf and support a cover on the body for swinging between open and closed positions. In one embodiment, the cover is made of plastic and is molded integrally with the hinge straps. In a second embodiment, the cover is made of metal and is secured to a second mounting leaf which is molded integrally with the hinge straps.

18 Claims, 8 Drawing Figures

CONTAINER WITH METAL BODY AND PLASTIC HINGE

BACKGROUND OF THE INVENTION

This invention relates to a container having a body for holding a product and having a cover for closing the body. More particularly, the invention relates to a container of the type in which the body is made of sheet metal and is formed with an upper lip portion defining an opening of predetermined size and shape. The cover is shaped as an inverted dish and includes a skirt depending from the periphery of a top wall having the same general size and shape as the opening in the body. When the cover is in a closed position, the top wall closes the opening of the body while the skirt telescopes downwardly over the lip portion of the body.

The invention is especially concerned with a container of the foregoing type in which the cover is hinged to a metal body to swing on the body between open and closed positions and in which the opening in the body is completely exposed when the cover is in its open position. Such a container is disclosed in Foster U.S. Pat. No. 3,695,481. In that container, the cover is made of plastic and is connected to the metal body by a plastic hinge which is molded integrally with the cover.

SUMMARY OF THE INVENTION

The general aim of the present invention is to provide a container of the foregoing character having a new and improved plastic hinge for securing a cover to a metal body, the hinge being better concealed and detracting less from the overall appearance of the container than prior hinges of the same general type.

Another object of the invention is to achieve the foregoing by providing a container having a unique plastic hinge which, for the most part, is concealed between the lip portion of the body and the skirt of the cover. Being so concealed, the hinge does not disrupt the aesthetic continuity of the container and does not interfere with the placement of decorative material on the container body.

A more detailed object is to provide a novel plastic hinge having a mounting leaf which is located in an inwardly offset recess in the lip portion of the body so as to enable the hinge axis to be located closely adjacent the body, the hinge also having unique web means which extend downwardly, inwardly and then upwardly from the skirt of the cover to the mounting leaf of the hinge.

Still another object is to provide a hinge of the foregoing type for supporting either a plastic cover on a metal cover on a metal body.

The invention also resides in the novel manner of connecting the hinge to the body and the cover.

These and other objects and advantages of the invention will become more apparent from the following detailed description when taken in conjunction with the accompanying drawings.

DETAILED DESCRIPTION OF THE PREFERRED EMBODIMENTS

Figure 1:
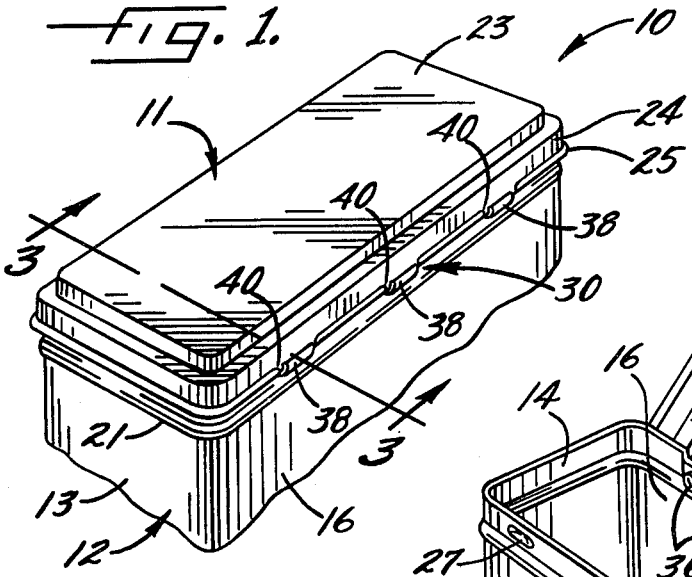
FIG. 1 is a fragmentary perspective view of one embodiment of a new and improved container incorporating the unique features of the present invention, the cover of the container being shown in a closed position.
Figure 2:
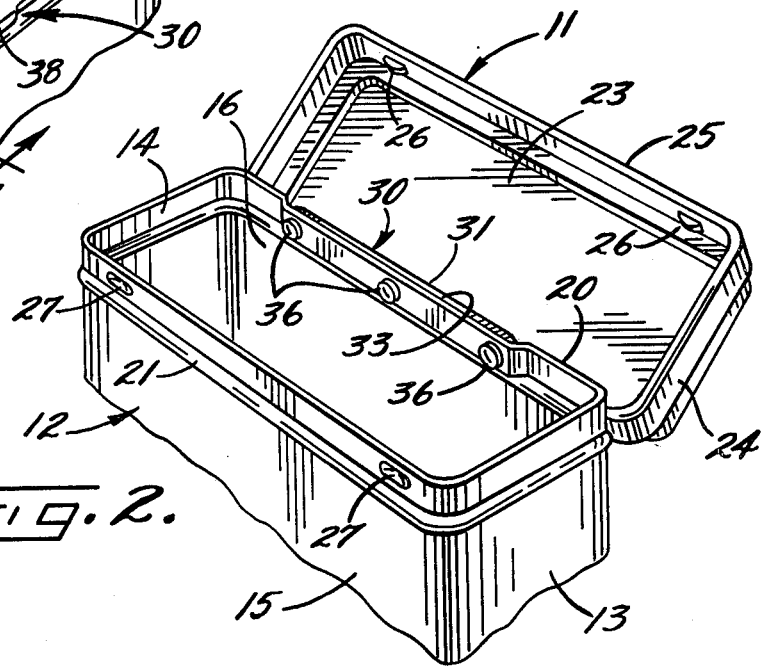
FIG. 2 is another fragmentary perspective view of the container but shows the cover in an open position.

As shown in the drawings for purposes of illustration, the invention is embodied in a container 10 having a cover 11 molded of resilient plastic and swingable between a closed position (FIG. 1) and an open position (FIG. 2) in which the full cross-section of a tubular body 12 of rectangular cross-section is uncovered. The body is made of sheet metal with relatively narrow end walls 13 and 14 and with substantially wider side walls 15 and 16. The ends of the metal sheet are interlocked with one another in a conventional manner to form a seam (not visible) which preferably is disposed on the inner side of the end wall 13 so as to leave the outer side of that wall substantially flat. A bottom member (not shown) made either of metal or plastic is permanently secured to the lower end of the body 12.

Figure 3:
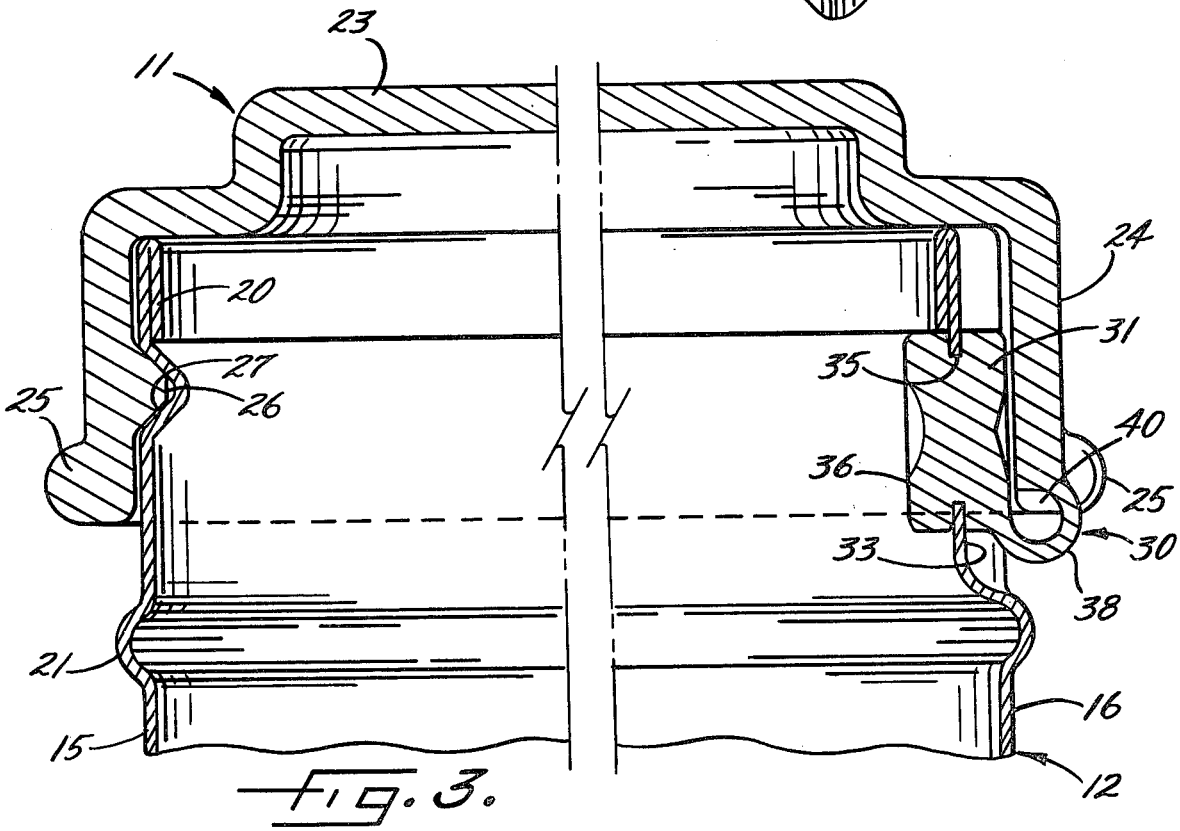
FIG. 3 is an enlarged fragmentary cross-section taken substantially along the line 3—3 of FIG. 1.

Extending around the upper periphery of the body 12 is a lip portion 20 (FIGS. 2 and 3) whose upper margin is folded inwardly and then downwardly into the body to avoid the presence of a sharp edge at the extreme upper end of the body. Located between the lip portion 20 and the main portion of the body 12 is a peripheral bead 21 which is formed by deforming the metal of the body outwardly.

The cover 11 is molded from resilient plastic such as polypropylene and includes a substantially flat top wall 23 having generally the same rectangular size and shape as the interior of the body 12. Molded integrally with and depending from the periphery of the top wall 23 is a skirt 24 having an outwardly projecting rounded bead 25 integral with its lower edge. When the cover is in its closed position on the body, the skirt 24 telescopes downwardly over the lip portion 20 of the body with the lower side of the bead 25 being located adjacent the upper side of the bead 21. The cover is mounted on the body to swing upwardly and downwardly between its open and closed positions and is adapted to be held releasably in its closed position by a pair of inwardly projecting nibs 26 (FIGS. 2 and 3) molded integrally with the inner side of the skirt 24 and sized to interlock with a releasable snap fit with a pair of indentations 27 formed in the lip portion 20 of the body adjacent the wide side 15 thereof.

In accordance with the present invention, the plastic cover 11 is swingably connected to the metal body 12 by a unique plastic hinge 30 which is almost entirely concealed between the lip portion 20 of the body and the skirt 24 of the cover. As a result, the aesthetic continuity of the container 10 is not significantly disrupted by the hinge and, in addition, the hinge does not interfere with the placement of decorative or informative printing which might be lithographed or otherwise placed on the exterior of the body.

More specifically, the hinge 30 comprises an elongated flat mounting leaf 31 (FIGS. 3 to 5) which is made of plastic and which, in the present instance, is molded integrally with the cover 11. In carrying out the invention, the mounting leaf 31 is received within an inwardly offset recess 33 (FIGS. 2 and 3) formed in the exterior of the lip portion 20 adjacent the wide side 16 of the body 12. The recess is formed by using coacting deforming dies (not shown) to inwardly offset an intermediate section of the lip portion from the adjacent end sections of the lip portion. The mounting leaf 31 lies in flat face-to-face relation with the recessed section 33 of the lip portion 20. The thickness of the mounting leaf 31 is equal to or is slightly less than the depth of the recess 33.

To secure the mounting leaf 31 to the body 12, a plurality of holes 35 (there herein being three holes) are formed through the recessed section 33 of the lip portion 20 and are spaced from one another along the lip portion. Three inwardly projecting lugs 36 are molded integrally with the inner side of the mounting leaf 31 and extend inwardly through the holes. The inner ends of the lugs are enlarged, as for example, by upsetting the ends of the lugs after the lugs have been inserted through the holes (see FIG. 3). Thus, the lugs secure the mounting leaf tightly and permanently to the body.

The hinge 30 is completed by flexible web means which could be continuous but which herein take the form of three short straps 38 (FIGS. 3 to 5) spaced from one another along the mounting leaf 31 and alined with the three lugs 36. The straps support the cover 11 for swinging between open and closed positions about an axis extending lengthwise along the lower end of the outer side of the recess 33. One end of each strap is molded integrally with the lower edge of the mounting leaf 31 while the other end of each strap is molded integrally with the outer side of the lower edge of the skirt 24. Three spaced notches 40 are formed in the bead 25 and accommodate the extreme outer end portions of the straps 38.

Figure 4:
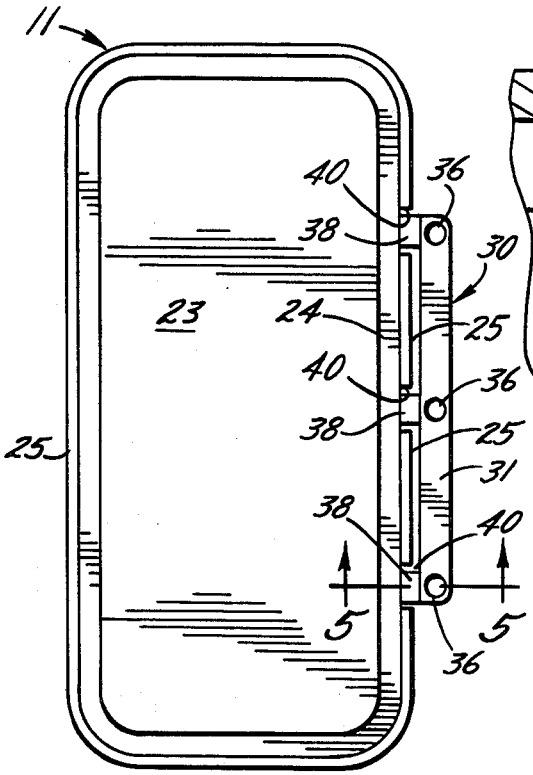
FIG. 4 is a top plan view of the cover detached from the body.
Figure 5:
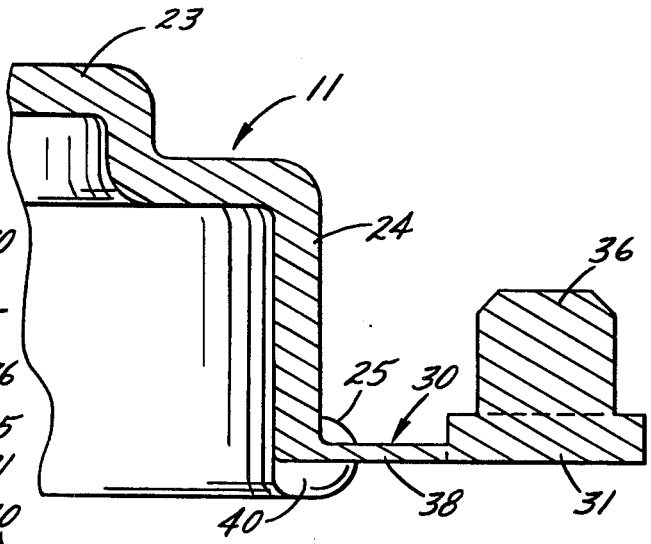
FIG. 5 is an enlarged fragmentary cross-section taken substantially along the line 5—5 of FIG. 4.

Molding of the cover 11 and the hinge 30 is effected with the leaf 31 and the straps 38 extending horizontally from the cover and with the lugs 36 extending upwardly as shown in FIGS. 4 and 5. When the cover is assembled with the body 12, the straps are flexed downwardly, inwardly and then upwardly to locate the mounting leaf 31 in the recess 33 and to enable the lugs 36 to project through the holes 35 (see FIG. 3). As a result of such flexing, the mounting leaf and portions of the straps become tucked between the skirt 24 of the cover 11 and the recess 33 of the lip portion 20 and are concealed from view from the outside of the container 10. Where the straps join the skirt, short segments of the outer end portions of the straps are visible but such end portions tend to blend in very smoothly with the rounded bead 25 since the end portions are received in the notches 40 and assume a rounded configuration (see FIG. 3) similar to that of the bead when the straps are flexed downwardly, inwardly and then upwardly preparatory to the hinge 30 being assembled with the body 12.

From the foregoing, it will be apparent that the present invention brings to the art a new and improved container 10 in which virtually all of the hinge 30 is concealed between the lip portion 20 of the body 12 and the skirt 24 of the swingable cover 11. The container thus has a pleasing and substantially uninterrupted appearance. The hinge does not occupy any space on the exterior of the body 12 and thus printed material on the body need not be arranged to accommodate the hinge. Because the mounting leaf 31 is located in the inwardly offset recess 33 in the lip portion 20, the hinge axis is located closely adjacent the side 16 of the body 12 so as to enable the skirt 24 to telescope freely over the lip portion with a close fit when the cover 11 is swung to its closed position.

Figure 6:
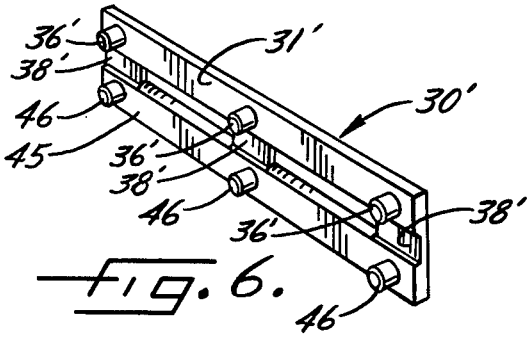
FIG. 6 is a perspective view of a hinge of another embodiment of a container incorporating the features of the invention.
Figure 7:
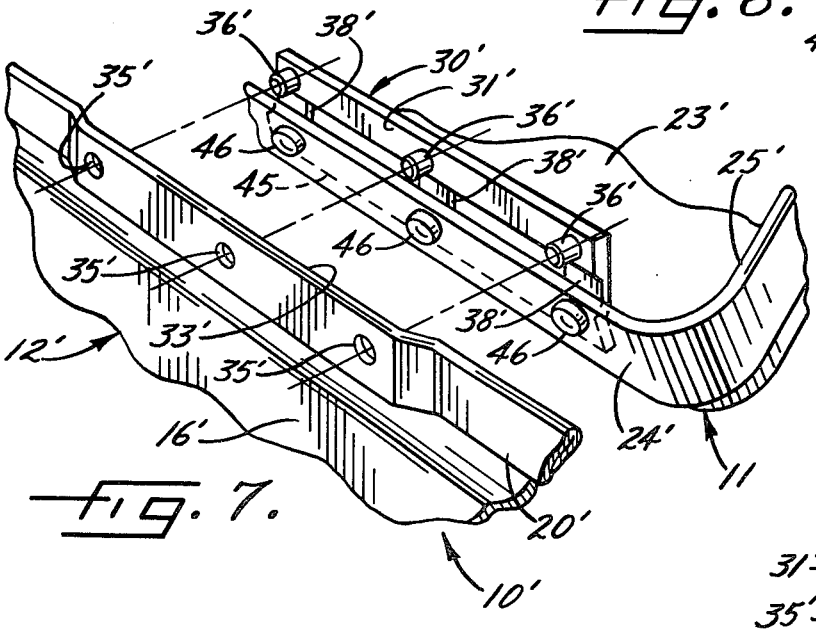
FIG. 7 is an exploded perspective view of the cover and the body of the container of the second embodiment.
Figure 8:
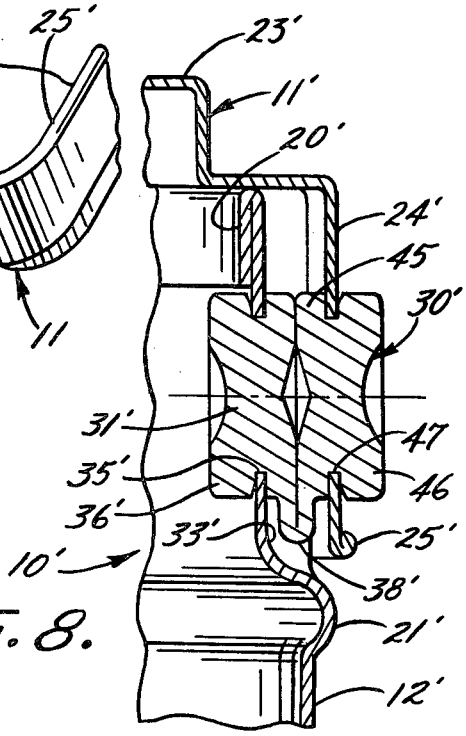
FIG. 8 is a fragmentary cross-section somewhat similar to FIG. 3 but shows the container of the second embodiment.

Another embodiment of a container 10' incorporating the novel features of the invention is shown in FIGS. 6 to 8 in which parts corresponding to parts of the container 10 of the first embodiment are indicated by the same but primed reference numerals. The container 10' is characterized in that it includes a plastic hinge 30' for connecting a metal cover 11' to a metal body 12'.

More specifically, the body 12' is identical to the body 12 and includes an upper lip portion 20' with an inwardly offset recess 33'. The cover 11' is virtually identical to the cover 11 but is made of metal. The cover 11' includes a top wall 23' and a depending peripheral skirt 24'.

Like the hinge 30, the hinge 30' includes a plastic mounting leaf 31' received in the recess 33' of the lip portion 20' and secured to the lip portion by three mounting lugs 36' extending through holes 35'. In addition, the hinge includes a second flat mounting leaf 45 which is disposed in face-to-face relation with the inner side of the skirt 24'. Three lugs 46 are molded integrally with and project outwardly from the outer side of the mounting leaf 45 and extend outwardly through three spaced holes 47 formed through the skirt. The outer ends of the lugs 46 are enlarged by upsetting in order to secure the mounting leaf 45 permanently to the skirt.

Web means in the form of three spaced straps 38' extend between the three lugs 36' of the mounting leaf 31 and the three lugs 46 of the mounting leaf 45. The straps mount the cover 11' for upward and downward swinging and are concealed between the lip portion 20' and the skirt 24' when the cover is in its closed position (see FIG. 8). Indeed, only the outer ends of the lugs 46 of the hinge 30' are visible from the outside of the container 10' when the cover is in its closed position since the two mounting leafs 31' and 45 also are concealed between the lip portion 20' and the skirt 24'. To avoid the need of recessing the skirt to accommodate the mounting leaf 45, the recess 33' is formed with a depth which is approximately equal to the combined thickness of the two mounting leafs.

I claim:

1. A container having a body and a cover, said body being made of metal and having an upper lip portion defining an opening of predetermined size and shape, said cover being shaped as an inverted dish and having a top wall of the same general size and shape as said opening, and a peripheral skirt formed integrally with and depending from said top wall and adapted to telescope over the lip portion of said body when said cover is in a closed position, said container being characterized in that an intermediate section of said lip portion is offset inwardly from the adjacent sections of said lip portion so as to define a recess along the outer side of said lip portion, a hinge made of plastic and having a mounting leaf located within said recess, means for securing said leaf to said lip portion, and flexible web means molded integrally with the lower edge of said leaf, connected to the skirt of said cover and supporting said cover to swing upwardly and downwardly between open and closed positions about a hinge axis extending along said recess.

2. A container as defined in claim 1 in which said means for securing said leaf to said lip portion comprise a plurality of holes formed through said lip portion and spaced from one another along said one side of said lip portion, and a plurality of lugs molded integrally with and projecting inwardly from the inner side of said leaf and extending into said holes.

3. A container as defined in claim 1 in which said cover is made of plastic, said web means being molded integrally with the skirt of said cover.

4. A container as defined in claim 1 in which said cover also is made of metal, said hinge having a second flat mounting leaf disposed in face-to-fact relation with the inner surface of said skirt, means for securing said second leaf to said skirt, said web means also being molded integrally with the lower edge of said second leaf.

5. A container having a body made of metal and having a cover made of plastic, said body having an upper lip portion defining an opening of predetermined size and shape, said lip portion having at least one substantially straight side, said cover being shaped as an inverted dish and having a top wall of the same general size and shape as said opening, and a skirt formed integrally with and depending from the periphery of said top wall and adapted to telescope over the lip portion of said body when said cover is in a closed position, said container being characterized in that an intermediate section of said one side of said lip portion is offset inwardly from the end sections of said one side of said lip portion so as to define a recess extending along the exterior of said one side of said lip portion, said recess being located in opposing relation with the inner side of said skirt when said cover is in said closed position, a hinge made of plastic and having a flat mounting leaf located within said recess and disposed in face-to-face relation with said lip portion, means for securing said leaf to said lip portion, and flexible web means molded integrally with said leaf and with said skirt and supporting said cover to swing upwardly and downwardly between open and closed positions about a hinge axis extending along said one side of said lip portion.

6. A container as defined in claim 5 in which said means for securing said leaf to said lip portion comprise a plurality of holes formed through said lip portion and spaced from one another along said one side of said lip portion, and a plurality of lugs molded integrally with and projecting inwardly from the inner side of said leaf and extending into said holes.

7. A container as defined in claim 6 in which said lugs extend inwardly through said holes, and means integral with the inner ends of said lugs and captivating said lugs in said holes.

8. A container as defined in claim 6 in which said web means comprise a plurality of short straps molded integrally with the lower edge of said leaf and with the outer side of the lower edge of said skirt, said straps being spaced from one another along said one side of said lip portion.

9. A container as defined in claim 5 in which said web means comprise a plurality of short straps molded integrally with the lower edge of said leaf and with the outer side of the lower edge of said skirt, said straps being spaced from one another along said one side of said lip portion.

10. A container as defined in claim 9 in which an outwardly projecting bead is formed around the lower margin of said skirt, a plurality of notches formed in and spaced along said bead, the outer end portions of said straps being disposed in said notches.

11. A container having a body and a cover both made of metal, said body having an upper lip portion defining an opening of predetermined size and shape, said lip portion having at least one substantially straight side, said cover being shaped as an inverted dish and having a top wall of the same general size and shape as said opening, and a skirt formed integrally with and depending from the periphery of said top wall and adapted to telescope over the lip portion of said body when said cover is in a closed position, said container being characterized in that an intermediate section of said one side of said lip portion is offset inwardly from the end sections of said one side of said lip portion so as to define a recess extending along the exterior of said one side of said lip portion, said recess being located in opposing relation with the inner side of said skirt when said cover is in said closed position, a hinge made of plastic and having a first flat mounting leaf located within said recess and disposed in face-to-face relation with said lip portion, means for securing said first leaf to said lip portion, said hinge having a second flat mounting leaf disposed in face-to-face relation with the inner surface of said skirt, means for securing said second leaf to said skirt, and flexible web means molded integrally with the lower edges of said first and second leafs and supporting said cover to swing upwardly and downwardly between open and closed positions about a hinge axis extending along said one side of said lip portion.

12. A container as defined in claim 11 in which said means for securing said first leaf to said lip portion comprise a plurality of holes formed through said lip portion and spaced from one another along said one side of said lip portion, and a plurality of lugs molded integrally with and projecting inwardly from the inner side of said first leaf and extending into said holes.

13. A container as defined in claim 12 in which said lugs extend inwardly through said holes, and means integral with the inner ends of said lugs and captivating said lugs in said holes.

14. A container as defined in claim 12 in which said means for securing said second leaf to said skirt comprise a plurality of holes formed through and spaced along said skirt, and a plurality of lugs molded integrally with and projecting outwardly from the outer side of said second leaf and projecting into the latter holes.

15. A container as defined in claim 14 in which said web means comprise a plurality of short straps extending between and molded integrally with the lower edges of said first and second leafs, said straps being spaced from one another along said one side of said lip portion.

16. A container as defined in claim 11 in which said means for securing said second leaf to said skirt comprise a plurality of holes formed through and spaced along said skirt, and a plurality of lugs molded integrally with and projecting outwardly from the outer side of said second leaf and projecting into said holes.

17. A container as defined in claim 16 in which said lugs extend outwardly through said holes, and means integral with the outer ends of said lugs and captivating said lugs in said holes.

18. A container as defined in claim 11 in which said web means comprise a plurality of short straps extending between and molded integrally with the lower edges of said first and second leafs, said straps being spaced from one another along said one side of said lip portion.

* * * * *